US005774108A

United States Patent [19]

Michiyoshi

[11] Patent Number: 5,774,108

[45] Date of Patent: Jun. 30, 1998

[54] PROCESSING SYSTEM WITH DISPLAY SCREEN SCROLLING

[75] Inventor: Takashi Michiyoshi, Toyonaka, Japan

[73] Assignee: Ricoh Company, Ltd., Tokyo, Japan

[21] Appl. No.: 668,252

[22] Filed: Jun. 20, 1996

[51] Int. Cl.[6] ..... G09G 5/34

[52] U.S. Cl. ..... 345/123; 345/141

[58] Field of Search ..... 345/123, 124, 345/121, 125, 128, 141, 192, 193, 194, 25, 26

[56] References Cited

U.S. PATENT DOCUMENTS 4,445,114 4/1984 Stubben .
4,803,478 2/1989 Olsen ..... 345/123
4,922,238 5/1990 Aoki et al. ..... 345/123
4,940,970 7/1990 Fujisaku ..... 345/124
5,459,490 10/1995 Miyake .

*Primary Examiner*—Chanh Nguyen
*Attorney, Agent, or Firm*—Cooper & Dunham LLP

[57] ABSTRACT

The present invention provides a processing system capable of displaying images on a screen and moving the images on the screen in response to for example user input. The system displays images on, for example, a computer monitor or a video game monitor using an image display apparatus that includes a background screen control portion that provides image data for one or more background screens and which is capable of performing horizontal and vertical scrolling functions.

16 Claims, 10 Drawing Sheets

DISPLAY DATA
15
14
SHIFT REG.
DOT CLK
12
IMAGE MEM.
TABLE MEMORY
10
9
LOAD
LOAD TIMING GENERATING
6
HS
HORIZONTAL ADDER
VERTICAL ADDER
VS
7
VSYNC
HSYNC
DISPLAY PERIOD SIGNAL
DISPLAY TIMING GENERATING
8
H
V
HO
HORIZ. OFFSET REG.
3
H
HORIZ. COUNTER
1
VCE
V
EN
VERT. CTR.
2
VO
VERT. OFFSET REG.
4
DOT CLK
DOT CLK

DISPLAY DATA
15
14
LOAD DATA
DOT CLK
13
LATCH
G
LOAD
9
12
IMAGE MEM.
LG
LOAD TIMING GENERATING CIRCUIT
TABLE MEMORY
11
LATCH TIMING GEN. CKT.
10
VSYNC
HSYNC
DISPLAY PERIOD SIGNAL (DISP)
6
HS
HORIZONTAL ADDER
VERTICAL ADDER
VS
7
5
CARRY GEN. CIRCUIT
8
DISPLAY TIMING GEN. CKT.
H
V
HO
H
V
VO
HORIZ. OFFSET REG.
HORIZ. COUNTER
VERT. COUNTER
VERT. OFFSET REG.
3
1
2
4
DOT CLK
VCE
DOT CLK
124

HORIZONTAL OFFSET VALUE = $\phi$

HORIZONTAL OFFSET VALUE = 3

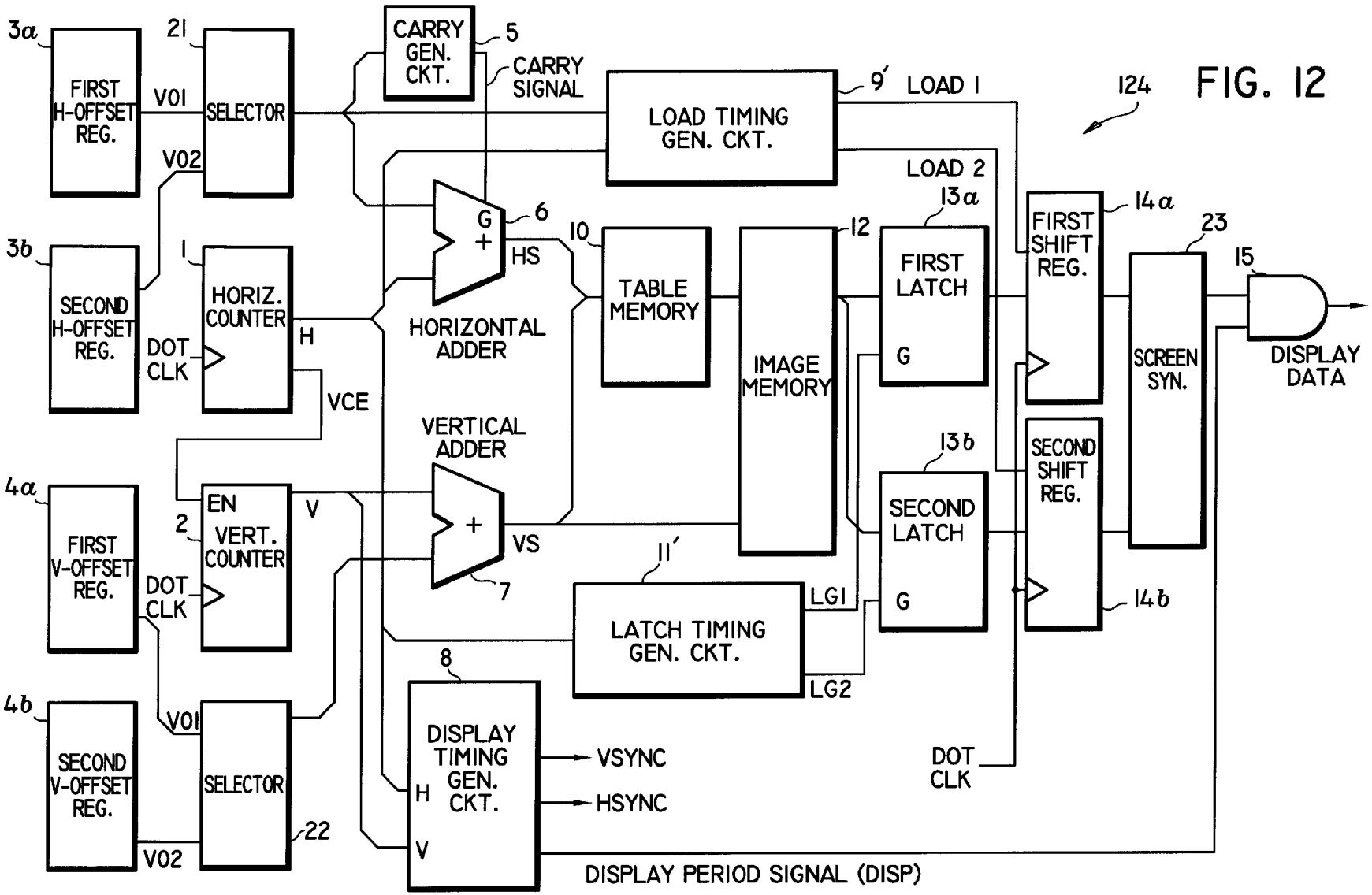
FIG. 12
124
DISPLAY DATA
15
23
SCREEN SYN.
14a
14b
FIRST SHIFT REG.
SECOND SHIFT REG.
LOAD 1
LOAD 2
13a
FIRST LATCH
G
13b
SECOND LATCH
G
DOT CLK
9'
12
IMAGE MEMORY
LG1
LG2
LOAD TIMING GEN. CKT.
TABLE MEMORY
11'
LATCH TIMING GEN. CKT.
VSYNC
HSYNC
DISPLAY PERIOD SIGNAL (DISP)
10
6
HS
CARRY SIGNAL
5
CARRY GEN. CKT.
G
+
HORIZONTAL ADDER
VERTICAL ADDER
VS
7
8
DISPLAY TIMING GEN. CKT.
H
V
VCE
H
V
22
SELECTOR
HORIZ. COUNTER
EN
VERT. COUNTER
SELECTOR
21
V01
V02
1
DOT CLK
2
DOT CLK
V01
V02
FIRST H-OFFSET REG.
SECOND H-OFFSET REG.
FIRST V-OFFSET REG.
SECOND V-OFFSET REG.
3a
3b
4a
4b

PROCESSING SYSTEM WITH DISPLAY SCREEN SCROLLING

BACKGROUND OF THE INVENTION

1. Field of the Invention

The present invention relates to processing systems capable of scrolling images displayed on a display screen. More particularly, the present invention relates to a processing system, such as a personal computer or video game machine, having an image display apparatus capable of scrolling one or more background images on a display.

2. Description of the Related Art

Symbol and screen scrolling units that scroll images displayed on a display screen are known. One example of such a unit has registers for setting a horizontal displacement value for horizontally scrolling a symbol across a display. This conventional symbol scrolling unit is structured so that outputs from vertical and horizontal registers and horizontal and vertical counter values are added by an adder. The output of the adder is used to address a background screen memory (a stadium RAM) which maps the character (or symbol) to be displayed. Output data from the memory is used to address a character memory (a graphic RAM) to retrieve from the memory image data representing the character to be displayed. The image data of the character is then converted to a serial format by a parallel-to-serial converter and stored in a shift register. The output of the shift register is transferred to a color converter by a multiplexer. A signal from the horizontal scroll register is used as the address input for the multiplexer so as to selectively transfer the outputs from the shift register to the color converter, and perform horizontal scrolling of a character.

However, the foregoing conventional image display apparatus scrolls an image across a display screen by causing the outputs from the shift registers to pass through the multiplexer. As a result, time delays occur due to the time required for the shift register to provide image data to the multiplexer and for the multiplexer to select the outputs. The effect of such delays is magnified when a color image is intended to be displayed. When displaying color images, the outputs from the shift registers temporarily become addresses for a color look-up table and the outputs of the table are then converted into RGB signals. The resolution of current display screens have improved so that the foregoing color conversion must be performed at high speed. However, the delays occurring in the shifting and selection process inhibits high speed operation of current systems.

To satisfy the requirements for displaying high resolution and/or color images, the amount of data needed to display such images significantly increases when compared to displaying low resolution, monochrome images. As a result, the amount of data that has to be fetched from memory and/or the number of shift registers used to scroll the image data must increase. However, the increase in the data quantity results in either an increase in the number of bits needed to address the multiplexer to select output paths, or an increase in the number of multiplexers used to display image data. As a result, the scale of the circuit is enlarged. An increase in the size of the circuits or in the number of components causes the manufacturing costs of the circuit to rise, and causes the density of LSI chips to increase.

SUMMARY

The present invention provides a processing system capable of displaying images on a screen and moving the images on the screen in response to for example user input. The system displays images on, for example, a computer monitor or a video game monitor using an image display apparatus that includes a background screen control portion that provides image data for one or more background screens and which is capable of performing horizontal and vertical scrolling functions.

In one embodiment the image display apparatus includes a first storage unit configured to store display order data representing at least one character display order, a second storage unit configured to store image data for forming an image of a character, and to output the image data when addressed by display order data output by the first storage unit, and a third storage unit is provided to store the image data transmitted by the second storage unit and to sequentially transmit the image data at a dot display rate. A fourth storage unit stores at least data indicating a quantity of horizontal offset of the display order data stored in the first storage unit. Timing circuitry is provided to count at least horizontal positions of dots represented by the image data to be displayed, and to load image data output by the second storage unit into the third storage unit, and an address generating circuit generates an address for input into the first storage unit. The address being derived at least in part by the quantity of offset stored in the fourth storage unit and the value counted by the counter. A switching circuit synthesizes one or more screens being displayed so as to provide a scrolling effect of one or more screens being displayed.

The present invention also provides a processing system with display screen scrolling. The processing system includes a processor having memory, stored programs and a user interface, the processor being configured to execute programs, to facilitate the display of image data on a display device, and to respond to signals received by the user interface so as to change the image data displayed, at least one user input device operatively coupled to the processor and configured to generate signals in response to user interaction with the input device, and an image display apparatus coupled to the processor and configured to generate image data for at least one screen to be displayed on the display device.

The image display apparatus includes a first storage unit configured to store display order data representing at least one character display order, a second storage unit configured to store image data for forming an image of a character and to output the image data when addressed by display order data output by the first storage unit, and a third storage unit is provided to store the image data transmitted by the second storage unit and to sequentially transmit the image data at a dot display rate. A fourth storage unit configured to store at least data indicating a quantity of horizontal offset of the display order data stored in the first storage unit. Timing circuitry is provided to count at least horizontal positions of dots represented by the image data to be displayed, and to load image data output by the second storage unit into the third storage unit, and an address generating circuit generates an addresses for input into the first storage unit. The addresses being derived at least in part by the quantity of offset stored in the fourth storage unit and the value counted by the counter. A switching circuit synthesizes one or more screens being displayed so as to provide a scrolling effect of one or more screens being displayed.

BRIEF DESCRIPTION OF THE DRAWINGS

Preferred embodiments of the present invention are described hereinbelow with reference to the drawings wherein:

FIG. 12 is a block diagram of another alternative embodiment of the background screen control portion of the image display apparatus according to the present invention.

DETAILED DESCRIPTION

Figure 1:
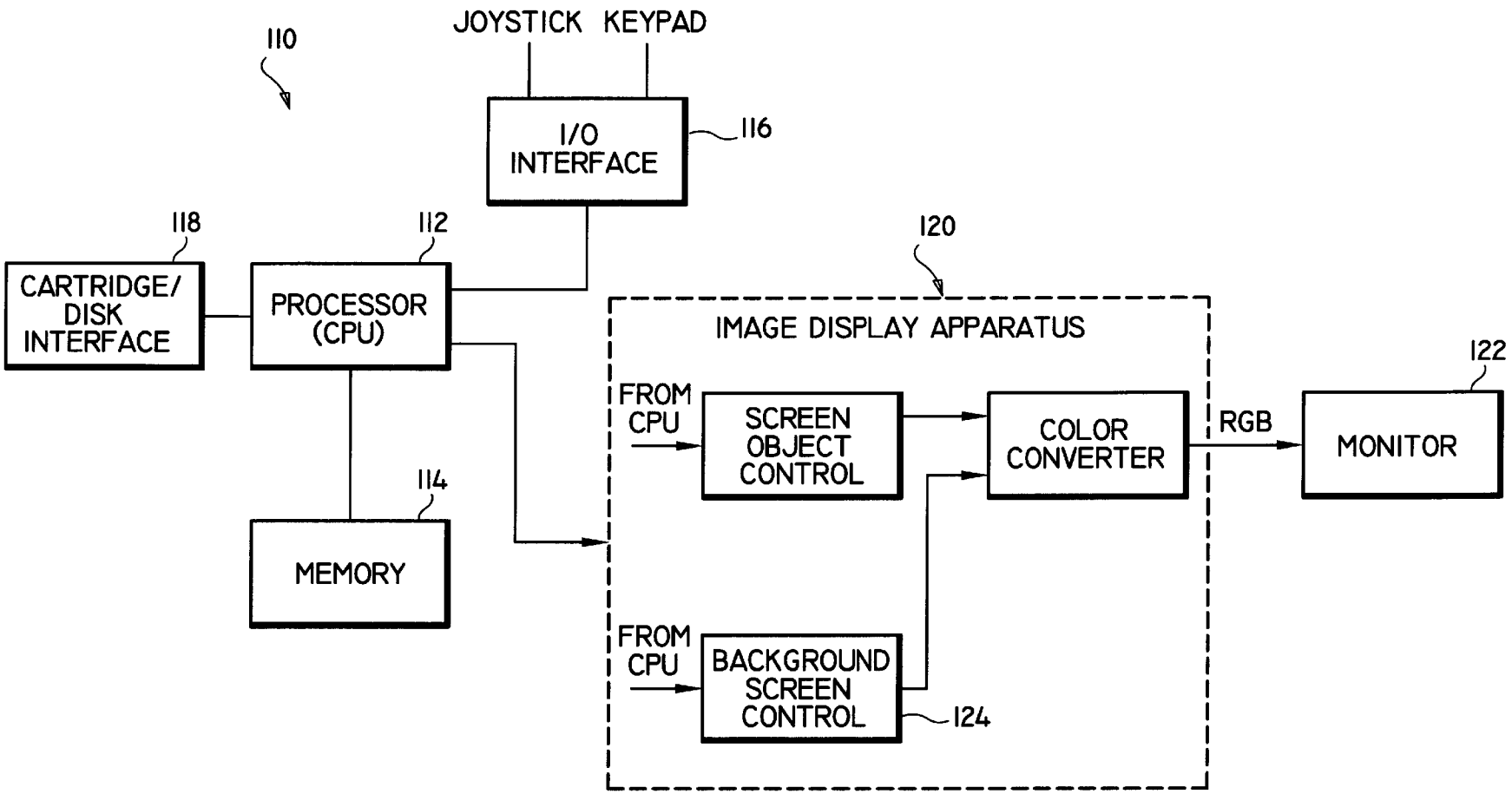
FIG. 1 is an exemplary block diagram of the processing system according to the present invention.

The present invention provides a processing system capable of displaying images on a screen and moving the images on the screen in response to user input. The system displays images on, for example, a computer monitor or a video game monitor or other suitable display devices, using an image display apparatus having a background screen control portion that provides image data for one or more screens and which is capable of performing horizontal and vertical scrolling functions. The processing system 110, seen in FIG. 1, includes a processor 112, memory 114 having stored programs, an input/output interface 116, and a cartridge/disk interface 118. The image display apparatus 120 is connected to the processor 112 and a monitor 122 or other equivalent display device. The processor provides to the image display apparatus image data representing characters that are to be displayed as, for example, a background screen or an object screen, and user input data (e.g., in the form of horizontal and/or vertical offset data).

Figure 2:
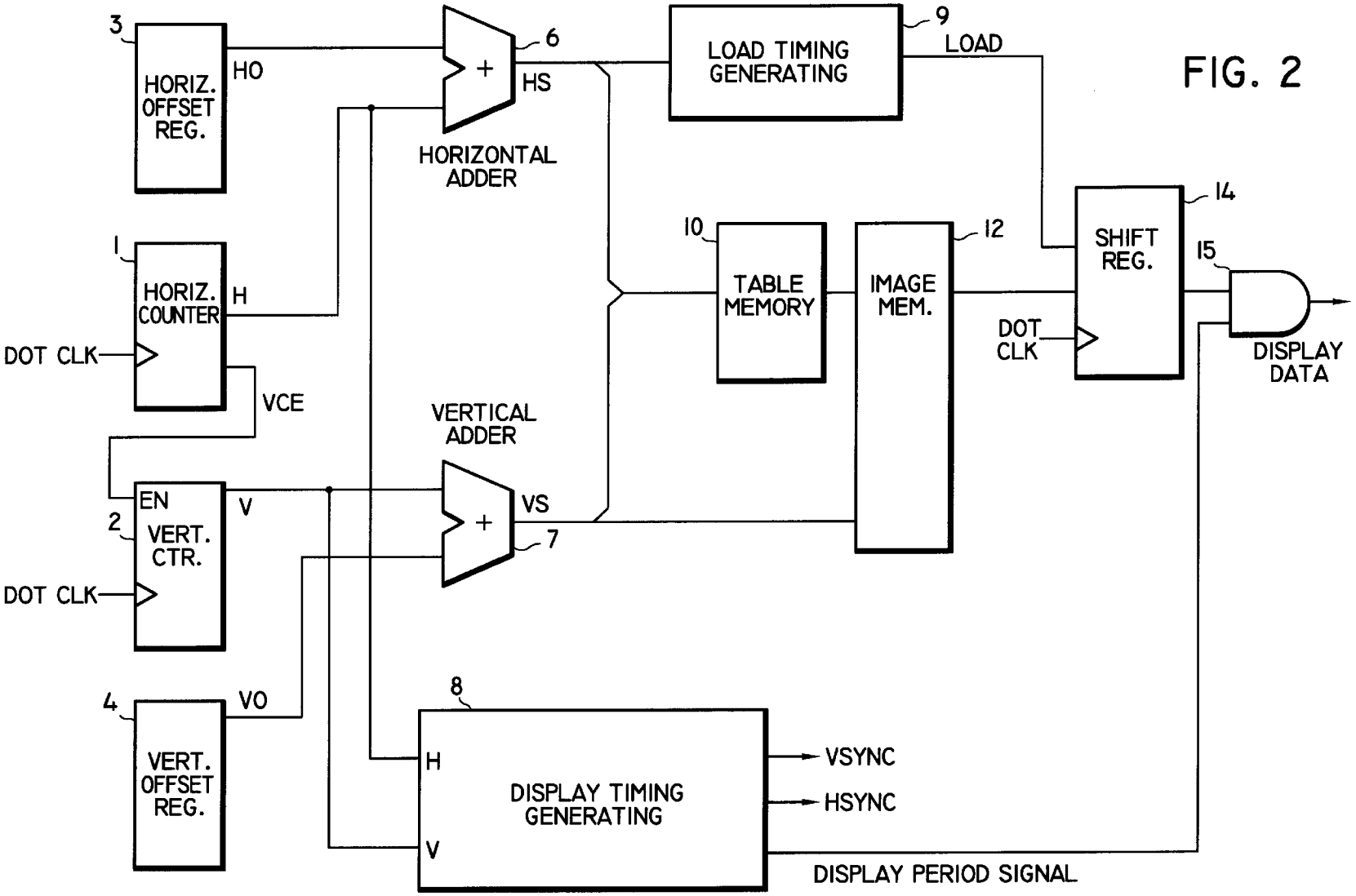
FIG. 2 is a block diagram of one embodiment of the background screen control portion of the image display apparatus according to the present invention.

Referring to FIG. 2, a block diagram of one embodiment of a background screen control portion 124 of the image display apparatus 120 according to the present invention is shown. The background screen control portion 124 can be configured to output image data for display of one or more background screens. The background screen control portion includes a horizontal counter 1 that counts dot clocks corresponding to one dot display period and outputs a horizontal count value (H). The horizontal count value is used as data corresponding to the horizontal position of a dot of a character to be displayed for one position in one horizontal period (which includes the horizontal blanking period). The data representing the horizontal count value may be 9 bits wide but the number of bits may vary depending upon, for example, the size of the background screen. The horizontal counter 1 also transmits a vertical count enable signal (VCE) whenever the horizontal count value of the horizontal counter circulates. That is, the vertical count enable signal is transmitted at the end of one horizontal period.

A vertical counter 2 also counts the number dot clocks when the counter is enabled by the vertical count enable signal from the horizontal counter 1. The vertical count value (V) is used as data corresponding to the vertical position of a dot of a character to be displayed for one screen display period (which includes the vertical blanking period). The data representing the vertical count value may be 9 bits wide but the number of bits may vary depending upon, for example, the size of the background screen.

Figure 3:
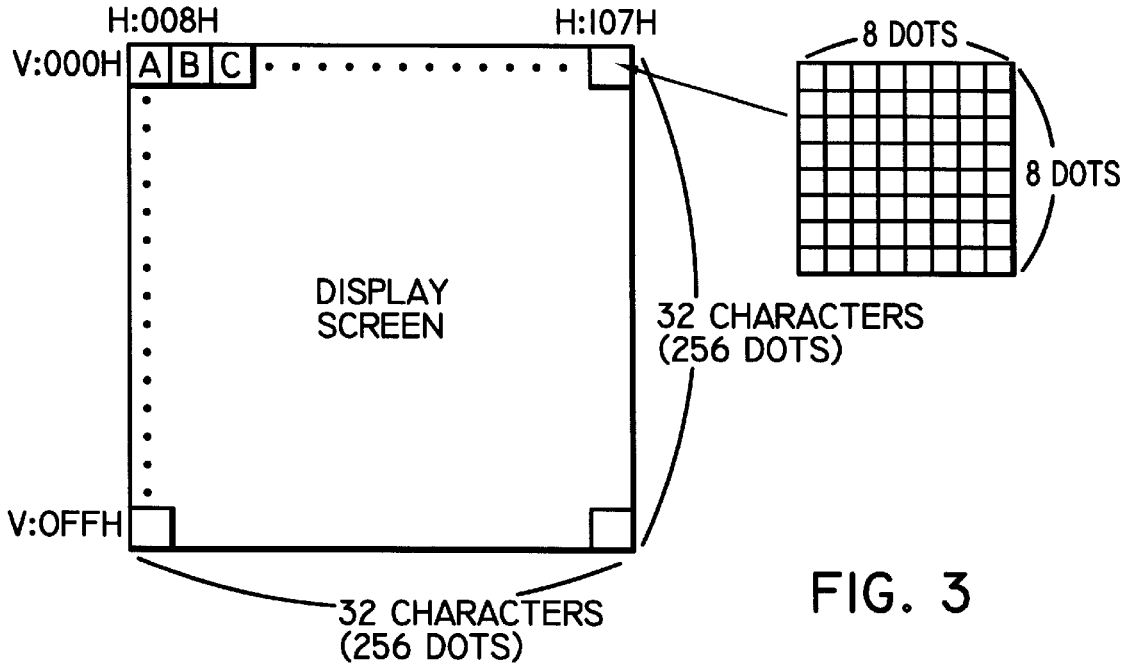
FIG. 3 is a block diagram of an exemplary display screen configuration used with the image display apparatus of the present invention.

For the purpose of the present description each character unit is 8 dots×8 dots, the display screen is a 256 dot×256 dot screen, and the background screen is 512 dots×512 dots, as depicted in FIG. 3. However, the size of each character unit and each screen may vary. For example, the character unit can be 16 dots×16 dots, the display screen can be 512 dots×512 dots and the background screen can be 4096 dots×4096 dots.

Figure 4:
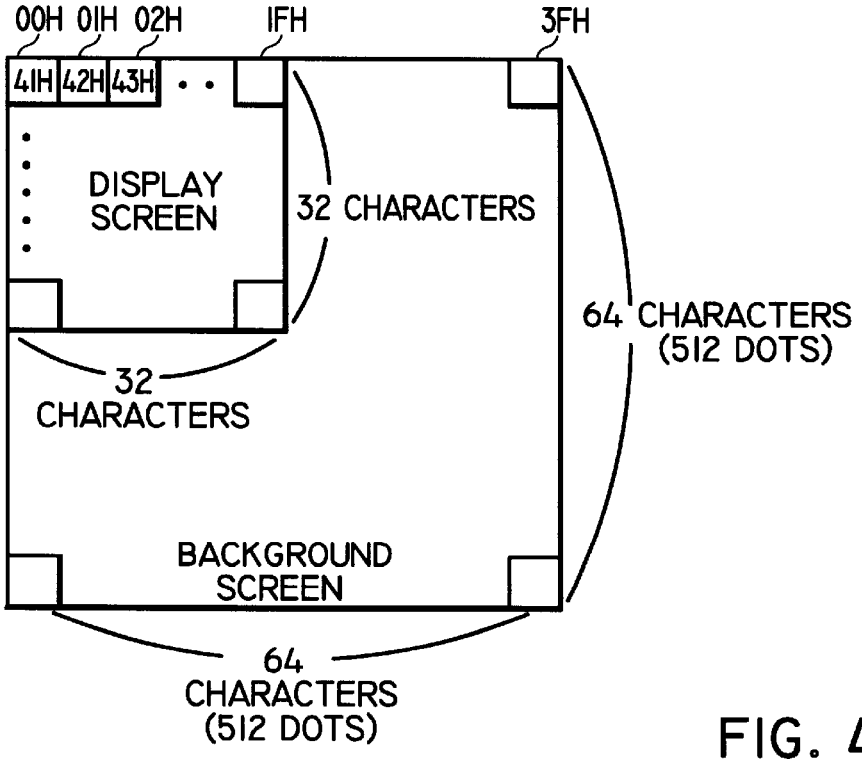
FIG. 4 is a block diagram illustrating a relationship between the display screen of FIG. 3 and a background screen.

In FIGS. 2–4, the horizontal counter 1 is operated in such a manner that its count value (H) is 008H when the first dot of the horizontal dots to be displayed is transmitted, and its count value (H) is 107H when the 256th dot of the dots to be displayed is transmitted, as seen in FIG. 3. Further, the vertical counter 2 is operated in such a manner that its count value (V) is 000H when the first line of the vertical lines to be displayed is transmitted and its count value (V) is 0FFH when the 256th line of the lines to be displayed is transmitted, as seen in FIG. 3.

Referring again to FIG. 2, horizontal and vertical offset data is entered by a user from, for example, a joystick or keypad, and the processor 112, seen in FIG. 1, determines the horizontal and/or vertical displacement of the character from its previous position (or relative to the display screen) and stores the horizontal and vertical offset values in horizontal offset register 3 and vertical offset register 4, respectively. Preferably, the output of each offset register is a nine bit signal. However, the number of output bits for each register is dependent upon various factors such as the size of the background screen.

A horizontal adder 6 receives an output signal (HO) from the horizontal offset register 3 and the horizontal count value (H) supplied from the horizontal counter 1 and provides an output signal (HS) that is the sum of these two signals. The data representing the sum may be 9 bits wide but the number of bits may vary depending upon, for example, the size of the background screen. If the adder output is nine bits, the six high-order bits (HS-3 to HS-8) of the result of the foregoing addition are connected to a table memory 10 and used as address data to read the table memory. The address data indicates the horizontal directional display position in character units which includes the quantity (or displacement) of the horizontal directional scroll in character units.

A vertical adder 7 receives an output signal (VO) from the vertical offset register 4 and the vertical count value (V) supplied from the vertical counter 2 and provides an output signal (VS) that is the sum of these two signals. The data representing the sum may be 9 bits wide but the number of bits may vary depending upon, for example, the size of the background screen. If the adder output is nine bits, the six high-order bits (VS-3 to VS-8) of the result of the foregoing addition are also connected to the table memory 10 and used as the address data to read the table memory. The address data indicates the vertical directional display position in character units including the quantity of vertical scroll in character units, and is a portion of the address to be instructed to the table memory 10. The three low-order bits (VS-0 to VS-3) of the vertical adder output form a low-order address portion for addressing the image memory 12, which specify one of 8 lines composing the character.

A display timing generating portion 8 receives the horizontal and vertical count values (H) and (V) and generates a vertical synchronizing signal (VSYNC), a horizontal synchronizing signal (HSYNC) and display period signal (DISP). The level of the display period signal goes high (logic 1) when the count value of the horizontal counter 1 is between 008H and 107H and the count value of the vertical counter 2 is between 000H and 0FFH.

A load timing generating portion 9 is connected to, for example, the three low-order bits (HS-0 to HS-2) from the horizontal adder 6 output and generates a loading signal (LOAD) in response to the data received from the horizontal adder. The loading signal (LOAD) is generated when, for example, the three low-order bits (HS-0 to HS-2) are "111". As will be discussed in more detail below, the loading signal loads data from image memory 12 into shift register 14.

As noted, the table memory 10 is connected to at least a portion of the output lines of the horizontal and vertical adders, and is used to transmit a one byte code (00H to FFH) indicating the type of the character stored at the foregoing address and corresponding to the display screen position. In this embodiment, each character is a code such that character A is assigned, for example, a code "41" and character B is assigned code "42", as seen in FIGS. 3 and 4. The table memory 10 has a capacity which is preferably two times lengthwise and widthwise the table capacity of the display screen. So, for example, if the display screen is 32 characters×32 characters (see FIG. 3) then the capacity of the table memory is preferably 64 characters×64 characters, which in this example corresponds to the size of the background screen. Data is written into the table memory 10 by the CPU or like processing components. In the example of FIG. 2, the address bus for the table memory is 12 bits and the data bus is eight bits.

Figure 5:
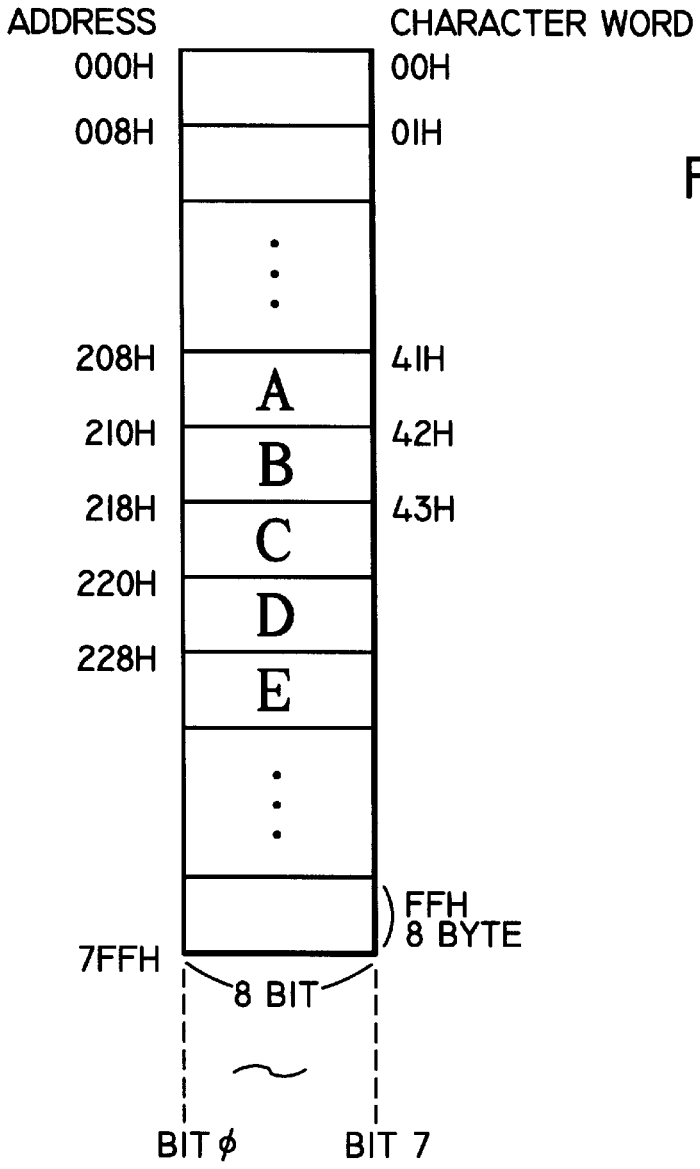
FIG. 5 is an example of a memory map for an image memory used in the image display apparatus of the present invention.
Figure 6A:
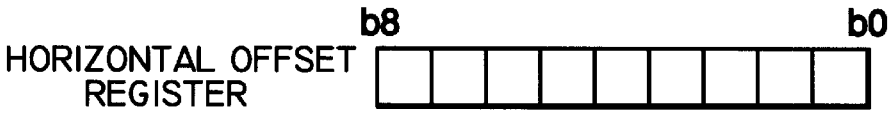
FIGS. 6*a* and 6*b* are block diagrams of horizontal and vertical offset registers used in the image display apparatus of the present invention.
Figure 6B:
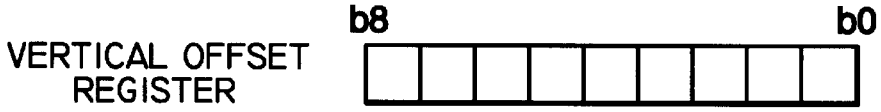

The image memory 12 stores character data for forming the image of any of a variety of characters. The output data from table memory 10 and the data on the low-order bits (VS-0 to VS-2) of the vertical adder output are used as the address data for the image memory 12. Thus, the image memory 12 receives, for example, an 11-bit address signal, where the output from the table memory 10 specifies the character and the output from the vertical adder 7 specify the sequential order of the line composing the character, to transmit the addressed image (or character) data for one line to the shift register 14. As an example, the image memory 12 can have addresses 000H to 7FFH, as seen in FIG. 5., and a character "A" can be stored at the addresses 208H to 20FH.

The shift register 14 stores character data for one line transmitted by the image memory 12 to sequentially, for each dot, transmit the character data in accordance with the dot clocks (the dot display timing). Loading of the shift register 14 starts in response to the loading signal (LOAD) supplied from the load timing generating portion 9.

A switching circuit such as gate 15 uses the display period signal (DISP) generated by the display timing generating circuit 8 and the output from the shift register 14 to transfer image data to be displayed. That is, the output from the shift register 14 is transmitted as data to be displayed only when the level of the display period signal is high.

Figure 7:
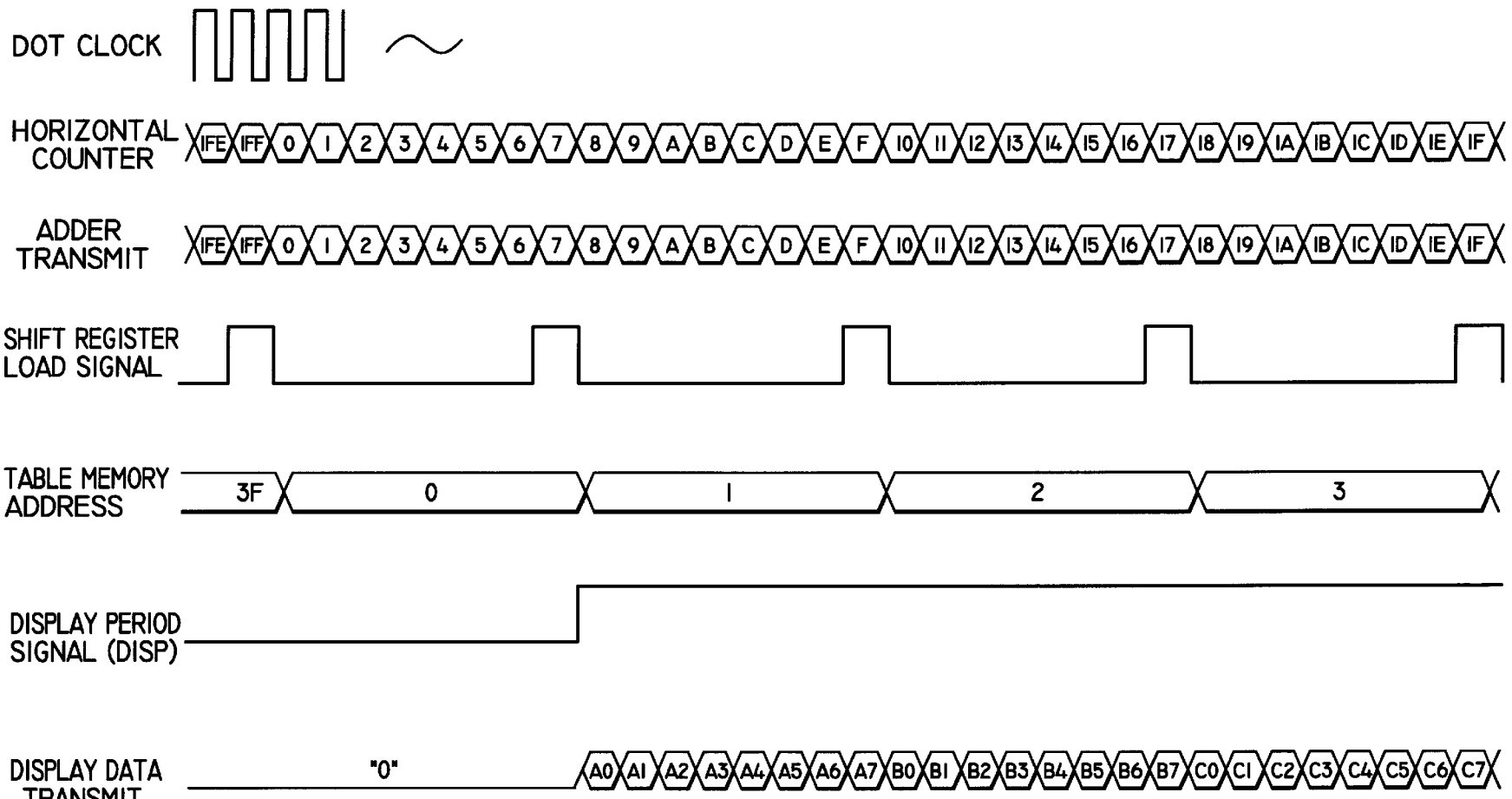
FIG. 7 is a timing diagram for the display of image data from the background screen control portion of FIG. 2 when a horizontal offset value is "0"
Figure 8:
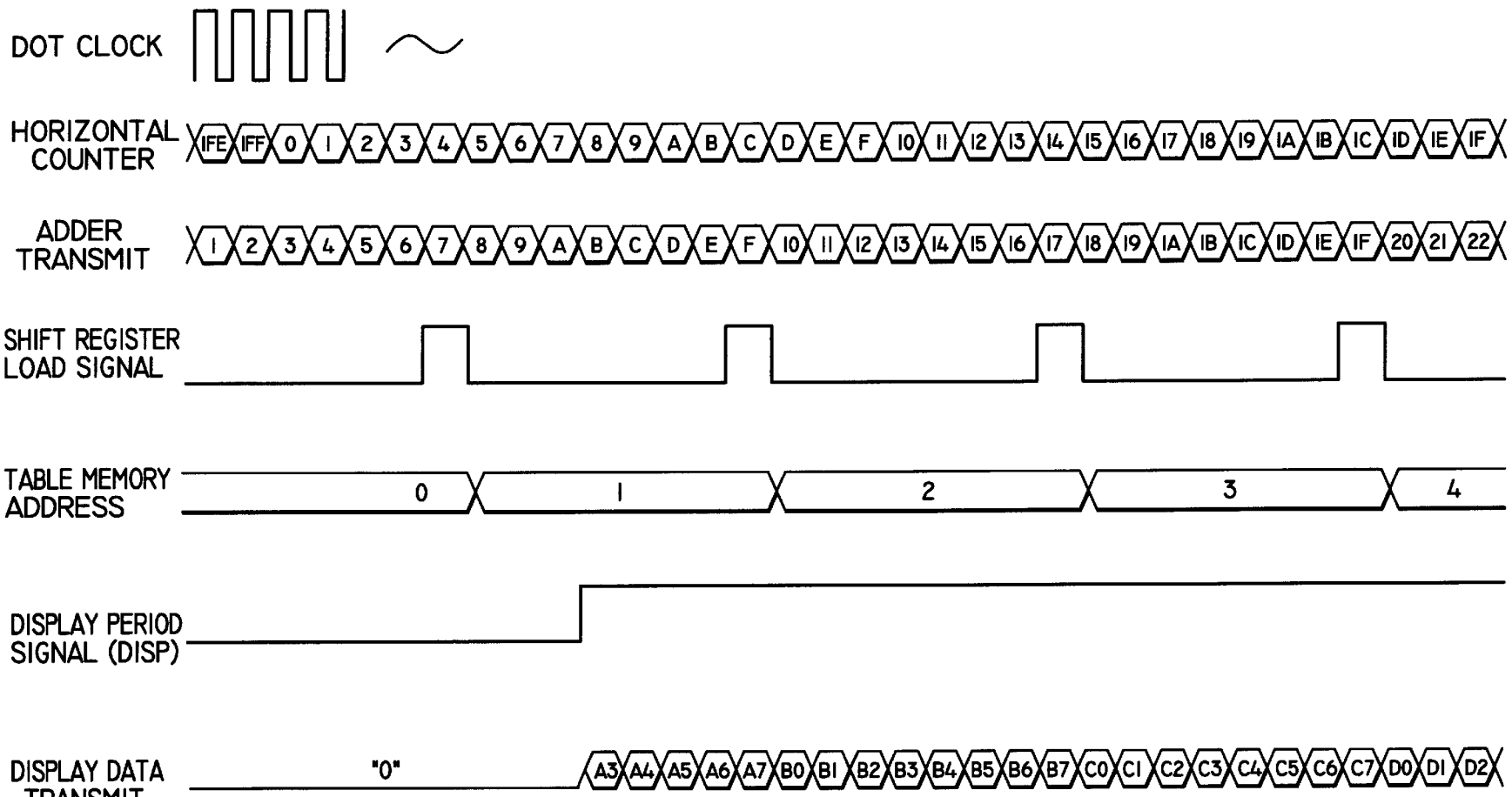
FIG. 8 is a timing diagram for the display of image data from the background screen control portion of FIG. 2 when a horizontal offset value is "3"

FIG. 7 shows a timing diagram for reading address data from table memory 10 and image data from image memory 12, and for outputting display data for display when the horizontal offset value is 0H. FIG. 8 shows a timing diagram for reading address data from table memory 10 and image data from image memory 12, and for outputting display data for display when the horizontal offset value is 3H. In each of FIGS. 7 and 8, the values of one bit of the vertical counter 2 (V) and the vertical offset register 4 (V0) are 000H.

In FIG. 7, since the horizontal offset value is 0H, the horizontal counter value (H) becomes the output signal from the horizontal adder 6. Further, the high-order bits (e.g. HS-3 to HS-8) of the horizontal adder output provide the address data used to read the table memory 10. Output data from the table memory 10 is used as the address data for reading character data from the image memory 12. The load timing generating portion 9 is supplied with the data from the low-order bits (e.g., HS-0 to HS-2) of the horizontal adder output. Since the horizontal offset value is 0H (i.e., the low-order bits of the horizontal offset register output are "000"), the load timing generating portion 9 transmits the loading signal after eight counts of the horizontal counter (e.g., when the horizontal count value (H) is for example, 7H, FH, 17H or 1FH).

When the horizontal count value (H) is 7H for example, image data A0 to A7 for the first line of the character "A", seen in FIG. 5, is transmitted from the image memory 12 and loaded into the shift register 14 when the loading signal goes high. When the loading signal is low, the shift register 14 outputs the image data (e.g., A0 to A7) in accordance with the dot clocks.

The display period signal (DISP) goes high when the horizontal counter value (H) is 8H. Since the timing at which the horizontal counter value becomes 8H and at the moment the loading signal goes high coincide with each other, the image data (A0 to A7) and data (B0 to B7, C0 to C7, etc.) for the first line of the following characters A, B, C, etc. are sequentially transmitted after the start of the display period. That is, when the horizontal offset value is 0H, image data items A0 to A7 are transmitted as data to be displayed.

In FIG. 8, since the horizontal offset value is 3H, a value obtained by adding 3 to the horizontal count value (H) becomes the output of the horizontal adder 6. Further, the high-order bits (e.g., HS-3 to HS-8) of the horizontal adder output provide the address data used to read the table memory 10. Output data from the table memory 10 is used as the address data to read character (or image) data from the image memory 12. The load timing generating portion 9 is supplied with data from the low-order bits (e.g., HS-0 to HS-2) of the horizontal adder output. Since the horizontal offset value is 3H (i.e., the low-order bits of the horizontal offset register output are "011") the load timing generating portion 9 transmits the loading signal after eight counts of the horizontal counter (e.g., when the horizontal count value is, for example, 4H, CH, 14H, or 1CH).

When the horizontal count value (H) is 4 for example, the image data A0 to A7 for the first line of the character "A" is transmitted from the image memory 12. When the loading signal goes high, the shift register 14 stores the image data A0 to A7 read from image memory 12. After the loading signal goes low, the shift register 14 transmits the image data A0 to A7 in accordance with the dot clocks.

The display period signal DISP goes high when the horizontal count value (H) is 8H. When the horizontal count value becomes 8H, the timing for generating the loading signal for the image data (A0 to A7) is offset by a degree corresponding to the horizontal offset value. Here the horizontal offset is 3H and thus the offset of the loading signal corresponds to three dot clocks. Therefore, output of the image data (A0 to A7) in accordance with the dot clocks starts to proceed with the display period signal (DISP) going high three dot clocks later so that after the start of the display period, image data items (A0 to A2) of the image data (A0 to A7) are not used as data to be displayed. Image data (A3 to A7) and data (B0 to B7, C0 to C7, etc.) for the first line of the following characters B, C, etc. are sequentially transmitted as data to be displayed. As a result, horizontal offset for three dots is accomplished. The figures shown herein provide timing examples when the horizontal offset value is 0H or 3H. However, the horizontal offset value may be different depending upon the size of the character unit, and the location of a particular character relative to the display screen and the background screen.

In this embodiment, the output load signal (LOAD) generated by the load timing generating portion 9 which loads shift register 14 with the character (or image) data from the image memory 12, occurs before the display period signal (DISP) by a value corresponding to the amount of displacement of the data for horizontal scrolling. That is, the period of time between the load signal and the display period signal is relative to the time to display a dot multiplied by the offset value stored in for example the horizontal offset register. As a result, dots in a predetermined sequential order composing one line of the character can be displayed at the foregoing display start timing, and horizontal scrolling in dot units can be performed. Since the timing at which data is loaded to the shift register 14 is controlled as described above (i.e., the offset is compensated for when data is loaded to the shift register 14), time delays associated with the loading and selecting of data for displaying a line of a character experienced with conventional scrolling units is prevented.

To increase the speed at which image (or character) data is displayed or refreshed, a cycle search or steal method may be employed in which access to the table memory 10 is made alternately by the CPU and the background screen control portion 124. One way to realize the foregoing method is to have the CPU access the table memory 10 when for example, the low-order output bits (e.g., HS-0 to HS-2) of the horizontal adder 6 are between "000" and "011", and to have the display controller access the table memory 10 when the low-order output bits (e.g., HS-0 to HS-2) of the horizontal adder are between "100" and "111".

Figure 9:
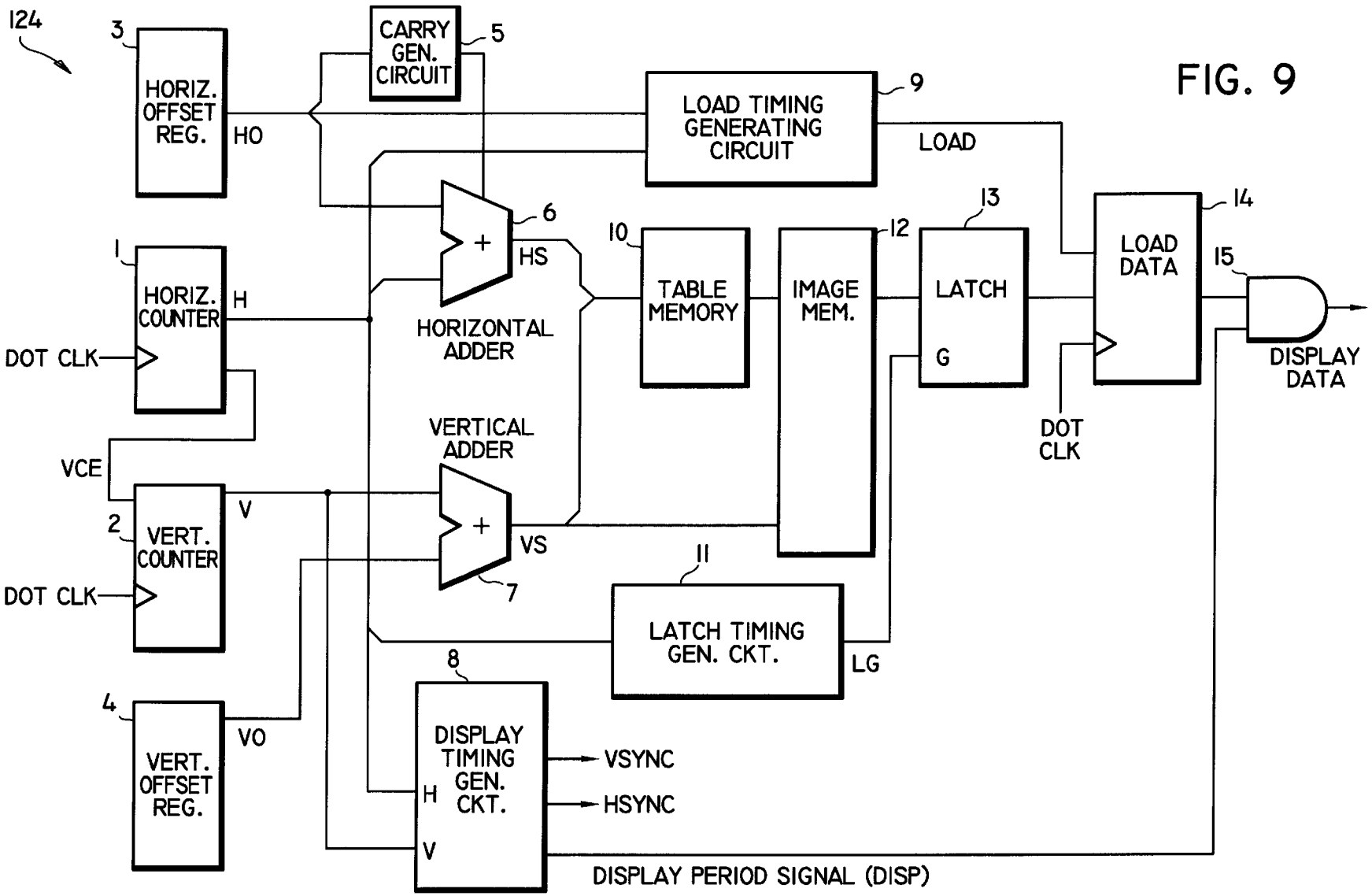
FIG. 9 is a block diagram of an alternative embodiment of the background screen control portion of the image display apparatus according to the present invention.
Figure 10:
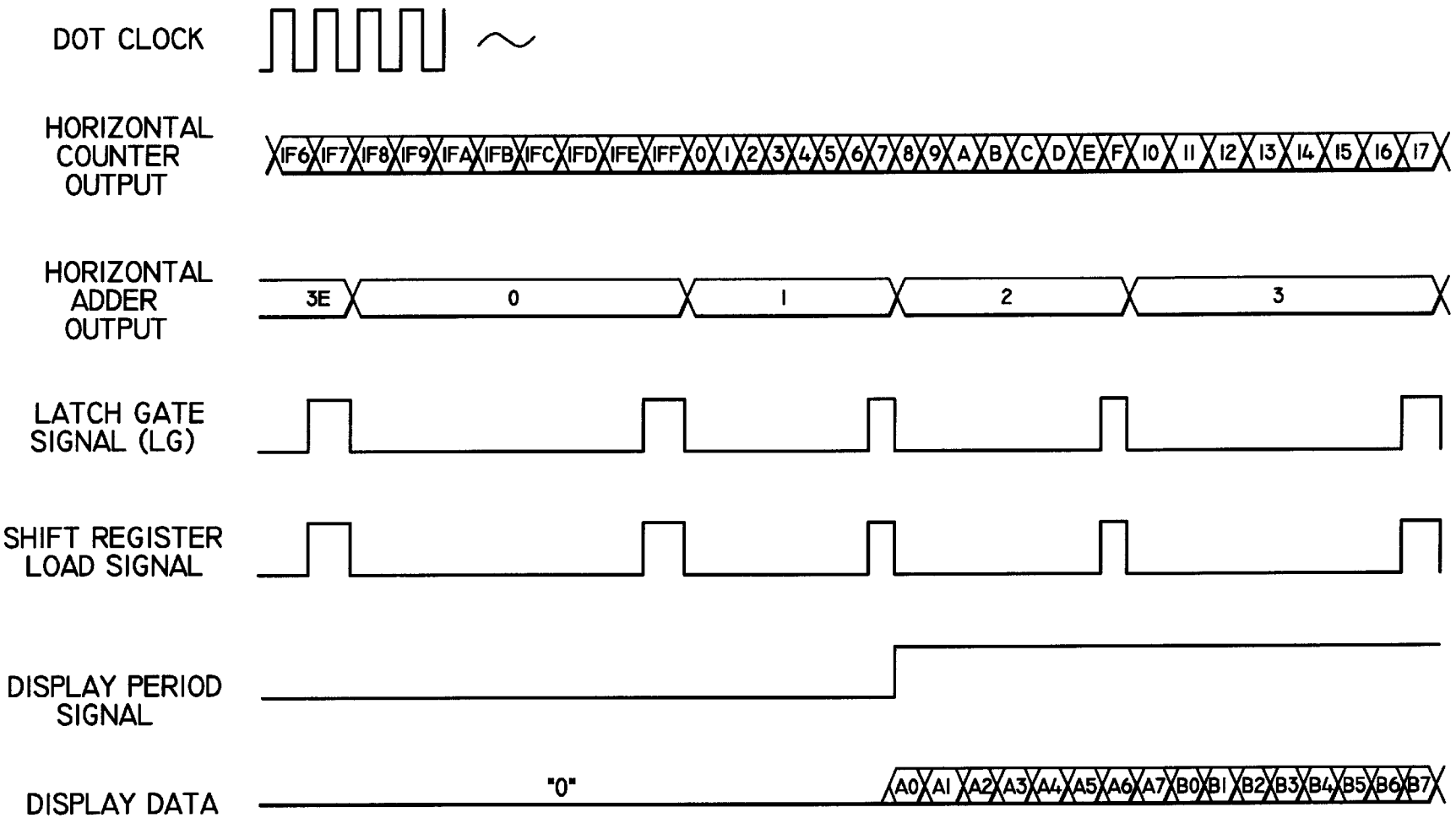
FIG. 10 is a timing diagram for the display of image data from the background screen control portion of FIG. 9 when a horizontal offset value is "0"
Figure 11:
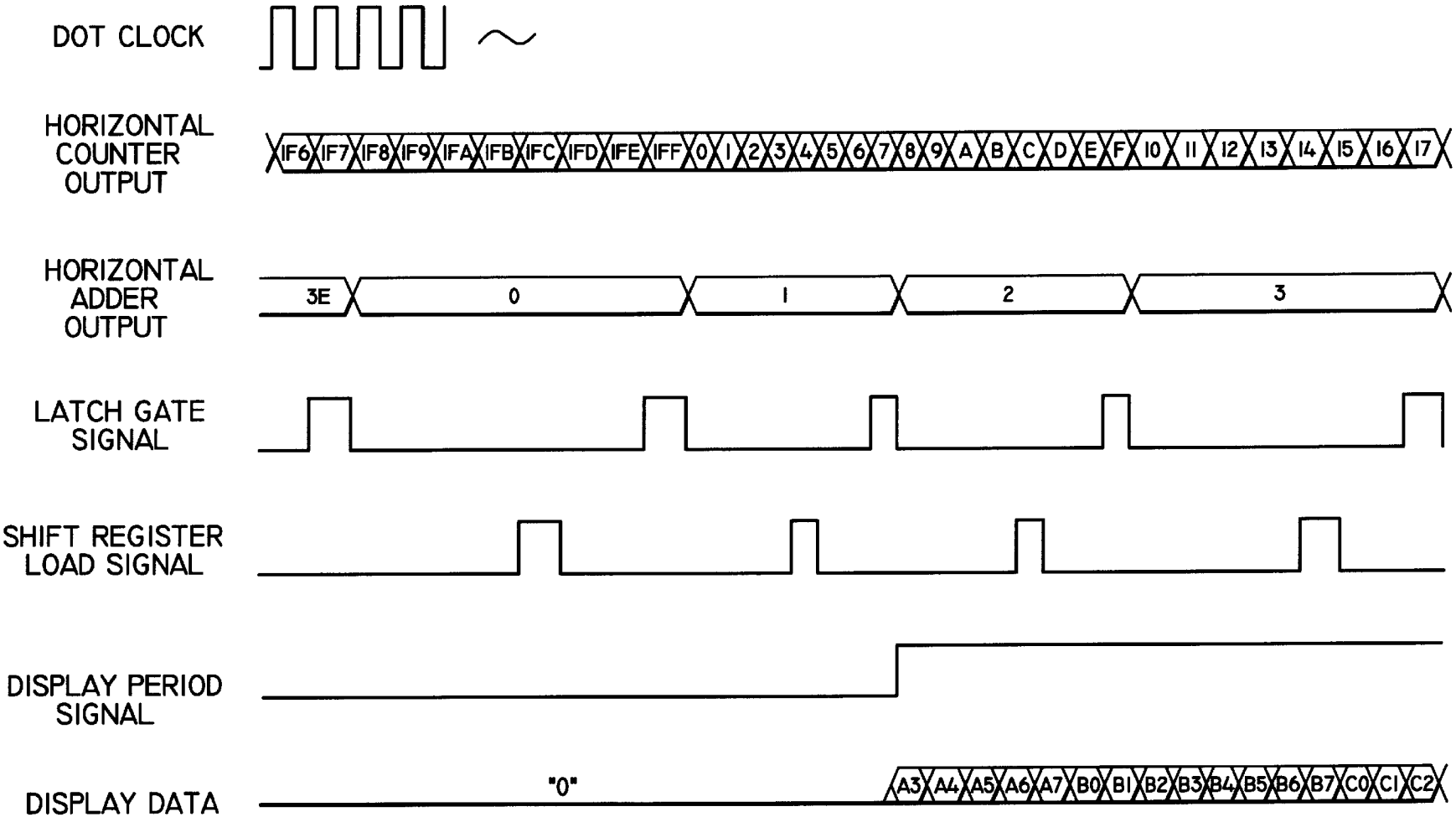
FIG. 11 is a timing diagram for the display of image data from the background screen control portion of FIG. 9 when a horizontal offset value is "3"

Referring now to FIGS. 9–11, an alternative embodiment of the background screen control portion 124 is shown. In this embodiment, the horizontal counter 1 counts dot clocks corresponding to one dot display period and outputs a horizontal count value (H). The horizontal count value is used as data corresponding to the horizontal position of a dot of a character to be displayed for one position in one horizontal period (which includes the horizontal blanking period). The data representing the horizontal count value may be 9 bits wide but the number of bits may vary depending upon, for example, the size of the background screen. The horizontal counter 1 also transmits a vertical count enable signal (VCE) whenever the horizontal count value of the horizontal counter circulates. That is, the vertical count enable signal is transmitted at the end of one horizontal period.

A vertical counter 2 also counts the number dot clocks when the counter is enabled by the vertical count enable signal from the horizontal counter 1. The vertical count value (V) is used as data corresponding to the vertical position of a dot of a character to be displayed for one screen display period (which includes the vertical blanking period). The data representing the vertical count value may be 9 bits wide but the number of bits may vary depending upon, for example, the size of the background screen.

Horizontal and vertical offset data is entered by a user from, for example, a joystick or keypad, and the processor 112, seen in FIG. 1, determines the horizontal and/or vertical displacement of the character from its previous position (or relative to the display screen) and stores the horizontal and vertical offset values in horizontal offset register (or fourth storage unit) 3 and vertical offset register (or fourth storage unit) 4, respectively. Preferably, the output of each offset register is a nine bit signal. However, the number of output bits for each register is dependent upon various factors such as the size of the background screen and the size of each character unit.

A horizontal adder 6 receives, for example, six high-order bits (HO3 to HO8) of the output signal (HO) from the horizontal offset register 3, and six high-order bits (H3 to H8) of the horizontal count value (H) from the horizontal counter 1. Upon receipt of these two inputs, the horizontal adder 6 produces the sum (HS) which is typically six bits, of these two inputs. This output is connected to a table memory 10 so as to be used as address data to read the table memory content data.

A vertical adder 7 receives an output signal (VO) from the vertical offset register 4 and the vertical count value (V) supplied from the vertical counter 2 and provides an output signal (VS) that is the sum of these two signals. The data representing the sum may be 9 bits wide but the number of bits may vary depending upon, for example, the size of the background screen. If the adder is nine bits, the six high-order bits (e.g., VS-3 to VS-8) of the result of the foregoing addition are also connected to the table memory 10 and used as the address data to read the table memory. The address data indicates the vertical directional display position in character units including the quantity of vertical scroll in character units, and is a portion of the address to be instructed to the table memory 10. The three low-order bits (e.g., VS-0 to VS-2) of the vertical adder output form a low-order address portion for addressing the image memory 12, and specify one of 8 lines composing the character.

A display timing generating portion 8 receives the horizontal and vertical count values (H) and (V) and generates a vertical synchronizing signal (VSYNC), a horizontal synchronizing signal (HSYNC) and display period signal (DISP). The level of the display period signal goes high (logic 1) when the count value of the horizontal counter 1 is between 008H and 107H and the count value of the vertical counter 2 is between 000H and 0FFH.

A carry generator circuit 5 has input lines connected to the output, preferably the low-order output lines (HO-0 to HO-2), of the horizontal offset register 3 and a carry output line connected to horizontal adder 6. The carry generator circuit is structured to transmit a logic low level signal when, for example, the value of the output bits supplied from the horizontal offset register 3 are "000". When, in this example, the output of the horizontal offset is other than 0, then the output of the carry generator is a high logic level.

A load timing generating portion 9 is connected to, for example, has input lines connected to the horizontal offset register output lines and the horizontal counter output lines, as noted above. As an example, the input of the load timing generating portion 9 is connected to three low-order bits (e.g., HO-0 to HO-2) of a 9-bit signal supplied from the horizontal offset register 3 and to three low-order bits (e.g., H-0 to H-2) of a 9-bit signal supplied from the horizontal counter 1. The load timing generating portion 9 generates a loading signal (LOAD) in response to the data received from the horizontal offset register and the horizontal counter. In this embodiment, the loading signal (LOAD) is transmitted when the complement value of each bit of the three low-order bits (H0-0 to H0-2) of the horizontal offset register output coincide with each bit of the three low-order bits (H-0 to H-2) of the horizontal counter output. In other words, for this example the loading signal goes high when ~HO-2 =H-2, ~HO-1 =H-1, and ~HO-0=H-0, where ~HO-0, ~HO-1, and ~HO-2 respectively show 2-bit inversions of HO-0, HO-1, and HO-2 respectively. The loading signal loads data from the image memory 12 into shift register 14.

To illustrate, when the three low-order output bits (HO-0 to HO-2) of the horizontal offset register are "000" (i.e., the horizontal offset is 0), the complement of the three low-order bits is "111". Thus, when the three low-order bits (H-0 to H-2) of the horizontal counter are "111", (i.e., when the horizontal count value is 7H), the loading signal goes high, as seen in FIG. 10. Simultaneously, the output from a latch (or fifth storage unit) 13, to be described later, is loaded. It should be noted that the latch 13 is typically a through-latch so that the data input to this latch is directly loaded in the shift register 14 when the loading signal goes high. When the three low-order output bits (HO-0 to HO-2) of the horizontal offset register are "011" (i.e., the horizontal offset is 3H), the complement of the three low-order bits of the horizontal offset register output is "100". Thus, when the three low-order bits (H-0 to H-2) of the horizontal counter output are "100" (i.e., when the horizontal count value is 4H) the level of the loading signal goes high, as seen in FIG. 11. After the fifth horizontal count value, the output from the latch (or fifth storage unit) 13, to be described later, is loaded into the shift register 14. Accordingly, the shift register is loaded with the image (or character) data before the display period signal (DISP) goes high. The time between when the shift register 14 is loaded and when the display period signal (DISP) goes high is based on the time period corresponding to the horizontal offset value (i.e., the quantity or displacement of horizontal scroll).

As noted, the table memory 10 is connected to at least a portion of the output lines of the horizontal and vertical adders, and is used to transmit a one byte code (00H to FFH) indicating the type of the character stored at the foregoing address and corresponding to the display screen position. In this embodiment, each character is a code such that character A is assigned, for example, a code "41" and character B is assigned code "42", as seen in FIGS. 3 and 4. The table memory 10 has a capacity which is preferably two times lengthwise and widthwise the table capacity of the display screen. So, for example, if the display screen is 32 characters×32 characters (see FIG. 3) then the capacity of the table memory is 64 characters×64 characters, which in this example corresponds to the size of the background screen. Data is written into the table memory 10 by the CPU or like processing components.

A latch timing generating circuit 11 generates a latch timing signal (LG) in accordance with the data on, for example, the three low-order output bits (e.g., H-0 to H-2) supplied from the horizontal counter 1. To illustrate, during a period in which the data on the three low-order output bits of the horizontal counter is "111", the latch timing generating circuit 9 generates and transmits a high level signal. The latch timing signal (LG) is a signal for determining the timing at which the image (or character) data transmitted by the image memory 12 is stored by the latch 13.

The image memory 12 stores character data for forming the image of any of a variety of characters. The output data from table memory 10 and the data on the low-order bits (e.g., VS-0 to VS-2) of the vertical adder output are used as the address data for the image memory 12. Thus, the image memory 12 receives, for example, an 11-bit address signal, where the output from the table memory 10 specifies the character, and the output from the vertical adder 7 specifies the sequential order of the line composing the character to transmit the addressed character data for one line to shift register 14. As an example, the image memory 12 can have addresses 000H to 7FFH, as seen in FIG. 5, and a character "A" can be stored at the addresses 208H to 20FH.

The latch 13 stores character data for one line transmitted by the image memory 12. As noted, data from image memory 12 is latched into the latch 13 by the latch timing signal from the latch timing generating portion 11. Data is latched at the first transition of the latch timing signal (e.g., on the rising edge of the latch timing signal). During a period in which the level of the latch timing signal is high, the latched data is transferred to the output lines.

A shift register 14 stores character (or image) data for one line transmitted by the latch 13 to sequentially, for each dot, transmit the character data in accordance with the dot clocks (the dot display timing). Loading of the shift register 14 starts in response to the loading signal (LOAD) supplied from the load timing generating portion 9.

A switching circuit such as gate 15 uses the display period signal (DISP) generated by the display timing generating circuit 8 and the output from the shift register 14 to transfer image data to be displayed. That is, the output from the shift register 14 is transmitted as data to be displayed only when the level of the display period signal is high.

FIG. 10 shows a timing a diagram for reading address data from the table memory 10 and image data from image memory 12, and for outputting display data for display when the horizontal offset value is OH. FIG. 11 shows a timing diagram that is similar to FIG. 10 but the horizontal offset value is 3H.

In FIG. 10, since the horizontal offset value is OH, the output of the carry generating circuit 5 is "0" and the output of the horizontal adder 6 is the sum of the horizontal offset register output and the horizontal count value. Therefore, when the horizontal count value is between 0H and 7H the output of the horizontal adder is 0H. When the horizontal count value from the horizontal counter 1 is between 8H and FH, the output of the horizontal adder is 1H.

The latch timing generating portion 11 transmits a latch timing signal (LG) when, for example, the low-order bits (e.g., H-0 to H-2) of the horizontal counter (H) are "111" (e.g., when the horizontal count value is 7H or FH) to latch the output image (or character) data from the image memory 12. In a case where the horizontal offset is 0, the three low-order output bits (H0-0 to H0-2) of the horizontal offset register are "000", and the loading signal (LOAD) goes high when the horizontal counter output is 7H or FH. Thus, data stored by the latch 13 is immediately loaded to the shift register 14. The shift register 14 transmits image data of each dot in accordance with the dot clocks.

As noted, the display period signal (DISP) goes high when the output of the horizontal counter (H) is 8H, so that the data items (A0 to A7, B0 to B7, C0 to C7, etc.) output by the shift register 14 for the first line of characters A, B, C, etc. (seen in FIGS. 2 and 3) are sequentially transmitted.

In FIG. 11, since the horizontal offset is 3H, the three low-order output bits (HO-0 to HO-02) of the horizontal offset register are "011". In this case, the output of the carry generating circuit 5 is 1H and the output of the horizontal adder 6 is a value obtained by adding 1H to the sum of the horizontal offset value and the horizontal count value. Therefore, when the horizontal count value (H) is between 0H and 7H, the output of the horizontal adder is 1H. When the horizontal count value (H) is between 8H and FH, the output of the horizontal adder is 2H. That is, if horizontal offset is present, the character to be read is caused to be scrolled by at least one character.

The latch timing generating portion 11 transmits a latch timing signal when the horizontal count value is, for example, "111" to latch the output image (or character) data from the image memory 12.

The description in the present application discusses using a horizontal offset value of is 3H when horizontal offset occurs, thus, the level of the loading signal (LOAD) goes high when the output of the horizontal counter is 4H or CH (e.g., when the three low-order bits of the horizontal counter are "100"). As a result, in this example the data stored by the latch 13 is delayed by four dot clocks before the data is loaded to the shift register 14 since the display period signal (DISP) is raised when the output (H) of the horizontal counter is 8H, data items A0, A1 and A2 of data (A0 to A7) for the first line of the character A are precluded from passing through the switching circuit 15. Thus, the foregoing data cannot be transmitted as data to be displayed and data items A3 to A7, B0 to B7, C0 to C7, etc.) of the characters A, B, C, etc. are sequentially transmitted.

According to the structure of this embodiment, the latch 13 stores the character (or image) data supplied from the image memory 12 when the level of the latch timing signal (LG) goes high. When horizonal offset is to be performed, the timing at which the shift register 14 stores the character data supplied from the latch 13 is changed in accordance with the quantity of offset stored in the horizontal offset register 3. For example, if the horizontal offset value is 3H which indicates a horizontal displacement of three dots, the change in the level of the loading signal (LOAD) supplied from the load timing generating portion 9 is delayed by a number of dot clocks corresponding to the value stored in the horizontal offset register, here 3 dot clocks. Therefore, the output data from the shift register 14 can be made to proceed over the display period signal (DISP) by a degree of the time period corresponding to the foregoing quantity of offset (dot display time multiplied by the offset value). As a result, horizontal scrolling of characters in dot units can be performed, without time delays experienced with conventional scrolling units.

It should be noted that the use of a structure similar to that shown in FIG. 9 enables a cycle search or steal method to be employed in which an increase the speed at which image (or character) data is displayed can be realized. To accomplish this, the table memory is alternately accessed by the CPU and the background screen control portion 124, seen in FIG. 9. One way to increase the speed at which the image data is displayed or refreshed is to configure the CPU to access the table memory 10 when, for example, the horizontal count value is between 0H and 3H, and to configure the background screen control portion 124 to access the table memory 10 when, for example, the horizontal count value is between 4H and 7H.

Another embodiment of the background screen control portion of the image display apparatus of the present invention will now be described with reference to FIG. 12. To minimize overlap in the description with the descriptions of the embodiments above, the functional portions of this embodiment which are the same as those discussed above are given the same reference numerals and a description thereof is omitted.

In this alternative embodiment, the background screen control portion 124 is capable of synthesizing and displaying two screens. However, more than two screens can be synthesized and displayed.

To synthesize image data items for two screens, there are provided; first and second horizontal offset registers 3*a* and 3*b*; first and second vertical offset registers 4*a* and 4*b*; first and second latches 13*a* and 13*b*; and first and second shift registers 14*a* and 14*b*. In addition, selectors 21 and 22 are provided to select offset data for each screen. Selector 21 is provided to output data from either the first or the second horizontal offset registers 3a or 3*b*, and the selector 22 is provided to output data from either the first or the second vertical offset registers 4*a* or 4*b*. A screen synthesizing circuit 23 is connected between the first and second shift registers 14*a* and 14*b* and the switching circuit 15 and is provided to synthesize image (or character) data output from the first and second shift registers 14*a* and 14*b*.

In this embodiment, a load timing generating portion 9' generates first and second loading signals (LOAD 1, LOAD 2); the first loading signal is used to load image data into the first shift register 14*a*; and the second loading signal is used to load image data into second shift register 14*b*. A latch timing generating portion 11' generates first and second latch timing signals (LG 1, LG 2); the first latch timing signal is used to latch image data into the first latch 13*a*; and the second latch timing signal is used to latch image data into the second latch 13*b*.

In this configuration, when the output of the horizontal counter is between 0H and 3H, for example, image data for a first image can be generated, and when the output of the horizontal counter is between 4H and 7H, image data for a second image can be generated. That is, when image data items for two screens are generated as described above, the level of the first latch timing signal goes high when the horizontal count value is 3H, and when the horizontal count value is 7H, the level of the second latch timing signal goes high. As a result, when output data from the image memory 12 is data for the first screen, the foregoing data is stored in the first latch 13*a*, and when output data from the image memory 12 is data for the second screen, the foregoing data is stored in the second latch 13*b*. The timing for storing image data for each screen is different.

When image data for the first screen is generated, the first horizontal offset register 3*a*, the first vertical offset register 4*a*, the first latch 13*a* and the first shift register 14*a* are employed so that the first loading signal (LOAD 1) and the first latch timing signal (LG1) are transmitted. As a result, the timing at which the first shift register 14*a* stores character (or image) data for the first image is changed in accordance with the quantity or displacement of offset of the first horizontal offset register 3*a* which indicates the quantity (or displacement) of scroll of the first screen.

When image data for the second screen is generated the second horizontal offset register 3*b*, the second vertical offset register 4*b*, the second latch 13*b* and the second shift register 14*b* are employed, and the second loading signal (LOAD 2) and the second latch timing signal (LG2) are transmitted. As a result, the timing, at which the second shift register 14*b* stores the character data supplied from the second latch 13*b* is changed in accordance with the quantity of offset of the second horizontal offset register 3*b* which indicates the quantity of scroll (or displacement) of the second screen.

Data items transmitted from the respective shift registers 14*a* and 14*b* are shifted in time relative to the display period signal (DISP) by a time period corresponding to the respective quantities of the offset. Thus, the two images are synthesized (addition of screens or giving priority to either screen) by the screen synthesizing portion 23, and a dot at a predetermined sequential order composing one line of the character located at the leftmost position in the upper portion of the screen of the synthesized screen is displayed initially. As a result, horizontal scroll in dot units can be realized in an image formed by synthesizing two screens.

It should be noted that the use of a structure similar to that shown in FIG. 12 enables a cycle search or steal method to be employed in which an increase the speed at which image (or character) data is displayed can be realized. To accomplish this, the table memory is alternately accessed by the CPU and the background screen control portion 124, seen in FIG. 12. One way to increase the speed at which the image data is displayed or refreshed is to configure the CPU to access the table memory 10 when, for example, the horizontal count value is between 0H and 3H, and to configure the background screen control portion 124 to access the table memory 10 when, for example, the horizontal count value is between 4H and 7H.

It will be understood that various modifications can be made to the embodiments of the present invention herein without departing from the spirit and scope thereof. For example, various character sizes and background screen sizes may be used in the image display apparatus. Therefore, the above description should not be construed as limiting the invention, but merely as preferred embodiments thereof. Those skilled in the art will envision other modifications within the scope and spirit of the invention as defined by the claims appended hereto.

What is claimed is:

1. An image display apparatus for displaying on a display screen a plurality of characters each of which is composed of a predetermined number of dots, said image display apparatus comprising:

a first storage unit configured to store display order data representing at least one character display order;

a second storage unit configured to store image data for forming an image of a character, and to output the image data when addressed by display order data output by said first storage unit;

a third storage unit configured to store the image data transmitted by said second storage unit and to sequentially transmit the image data at a dot display rate;

a fourth storage unit configured to store at least data indicating a quantity of horizontal offset of the display order data stored in said first storage unit;

timing circuitry configured to count at least horizontal positions of dots represented by the image data to be displayed, and to load image data output by said second storage unit into said third storage unit;

an address generating circuit configured to generate an address for input into said first storage unit, said address being derived at least in part by said quantity of offset stored in said fourth storage unit and said value counted by said counter; and a switching circuit configured to selectively transmit image data output from said third storage unit for subsequent display on a display screen.

2. The image display apparatus according to claim 1, wherein said first storage unit has a storage capacity that at least corresponds to the number of the characters to be displayed on the display screen.

3. The image display apparatus according to claim 1, wherein said second storage unit has a capacity capable of storing image data representing a plurality of characters to be displayed and is formed as a read-only or a read/write storage unit.

4. The image display apparatus according to any one of claim 1, wherein said third storage unit comprises a shift register that loads the image data stored in said second storage unit in response to a timing signal transmitted by said timing circuitry, and is arranged to shift the loaded image data at said dot display rate.

5. The image display apparatus according to any one of claim 1, wherein said fourth storage unit comprises a register having output bits wherein the number of bits corresponds to a number of horizontal dots and a number of vertical lines of a display space.

6. The image display apparatus according to claim 1, wherein said timing circuitry includes a counter for counting at least the horizontal positions of dots to be displayed.

7. The image display apparatus according to claim 1, wherein said address generated by said address generating circuit is the sum of said quantity of offset stored in said fourth storage unit and said value counted by said counter.

8. An image display apparatus for displaying on a display screen a plurality of characters each of which is composed of a predetermined number of dots, said image display apparatus comprising:

a first storage unit configured to store display order data representing at least one character display order;

a second storage unit configured to store image data for forming an image of a character, and to output the image data when addressed by display order data output by said first storage unit;

a third storage unit configured to store the image data transmitted by said second storage unit;

a fourth storage unit configured to store the image data transmitted by said third storage unit and to sequentially transmit the image data at a dot display rate;

a fifth storage unit configured to store at least data indicating a quantity of horizontal offset of the display order data stored in said first storage unit;

timing circuitry configured to count at least horizontal positions of dots represented by the image data to be displayed, to store image data output by said second storage unit into said third storage unit, and to load image data output by said third storage unit into said fourth storage unit;

an address generating circuit configured to generate an address for input into said first storage unit, said address being derived at least in part by said quantity of offset stored in said fourth storage unit and said value counted by said counter; and a switching circuit configured to selectively transmit image data output from said fourth storage unit for subsequent display on a display screen.

9. The image display apparatus according to claim 8, wherein said first storage unit has a storage capacity that at least corresponds to the number of the characters to be displayed on the display screen.

10. The image display apparatus according to claim 8, wherein said second storage unit has a capacity capable of storing image data representing a plurality of characters to be displayed and is formed as a read-only or a read/write storage unit.

11. The image display apparatus according to claim 8, wherein said third storage unit comprises a latch.

12. The image display apparatus according to claim 8, wherein said fourth storage unit comprises a shift register that loads the image data stored in said third storage unit in response to a timing signal transmitted by said timing circuitry and is arranged to shift the loaded image data at said dot display rate.

13. The image display apparatus according to claim 8, wherein said fifth storage unit comprises a register having output bits wherein the number of bits corresponds to a number of horizontal dots and a number of vertical lines of a display space.

14. The image display apparatus according to claim 8, wherein two or more third storage units and fourth storage units are provided for displaying a plurality of images, and said timing circuitry selectively stores image data from said second storage unit to one of said third storage units, and said timing circuitry selectively stores image data from one of said third storage units to one of said fourth storage units.

15. An image display apparatus for displaying on a display screen a plurality of characters each of which is composed of a predetermined number of dots, said image display apparatus comprising:

first storage means for storing display order data representing at least one character display order;

second storage means for storing image data for forming an image of a character, and for outputting the image data when addressed by display order data output by said first storage means;

third storage means for storing the image data transmitted by said second storage means;

fourth storage means for storing the image data transmitted by said third storage means and to sequentially transmit the image data at a dot display rate;

fifth storage means for storing at least data indicating a quantity of horizontal offset of the display order data stored in said first storage means;

counter means for counting at least horizontal positions of dots represented by the image data to be displayed;

first storage timing generating means for generating timing at which image data transmitted by said second storage means is stored by said third storage means in accordance with a value counted by said counter means;

second storage timing generating means for generating timing at which image data transmitted by said third storage means is stored by said fourth storage means in accordance with a value counted by said counter means and said quantity of offset stored in said fifth storage means; and means for displaying characters on a display screen in accordance with the image data sequentially transmitted by said fourth storage means.

16. A processing system that displays images and performs scrolling functions, comprising:

a processor having memory, stored programs and a user interface, said processor being configured to execute programs, to facilitate the display of image data on a display device, and to respond to signals received by said user interface so as to change the image data displayed;

at least one user input device operatively coupled to said processor and configured to generate signals in response to user interaction with said input device;

an image display apparatus coupled to said processor and configured to generate image data for at least one screen to be displayed on said display device, said image display apparatus having a first storage unit configured to store display order data representing at least one character display order, a second storage unit configured to store image data for forming an image of a character and to output the image data when addressed by display order data output by said first storage unit, a third storage unit configured to store the image data transmitted by said second storage unit and to sequentially transmit the image data at a dot display rate, a fourth storage unit configured to store at least data indicating a quantity of horizontal offset of the display order data stored in said first storage unit, timing circuitry configured to count at least horizontal positions of dots represented by the image data to be displayed, and to load image data output by said second storage unit into said third storage unit, an address generating circuit configured to generate an address to be input into said first storage unit, said address being derived at least in part by said quantity of offset stored in said fourth storage unit and said value counted by said counter, and a switching circuit configured to selectively transmit image data output from said third storage unit for subsequent display on a display screen.

* * * * *

UNITED STATES PATENT AND TRADEMARK OFFICE

CERTIFICATE OF CORRECTION

PATENT NO. : 5,774,108
DATED : June 30, 1998
INVENTOR(S) : Takashi MICHIYOSHI

It is certified that error appears in the above-identified patent and that said Letter Patent is hereby corrected as shown below:

Cover page, please add item --[30] Foreign Application Priority Data

| | | | |
|---|---|---|---|
| Jun. 21, 1995 | [JP] | Japan | 7-154200 |
| Jul. 19, 1995 | [JP] | Japan | 7-182895-- |

Signed and Sealed this

Second Day of May, 2000

*Attest:*

*Attesting Officer*

Q. TODD DICKINSON

*Director of Patents and Trademarks*